US005619002A

United States Patent [19]

Walck

[11] Patent Number: 5,619,002

[45] Date of Patent: Apr. 8, 1997

[54] TONE PRODUCTION METHOD AND APPARATUS FOR ELECTRONIC MUSIC

[75] Inventor: Jeffrey A. Walck, Lebanon, N.J.

[73] Assignee: Lucent Technologies Inc., Murray Hill, N.J.

[21] Appl. No.: 583,250

[22] Filed: Jan. 5, 1996

[51] Int. Cl.[6] ..... G10H 7/00; G10H 1/00

[52] U.S. Cl. ..... 84/603; 84/622; 84/DIG. 10

[58] Field of Search ..... 84/602–604, 608, 84/622–624, 627, DIG. 9, DIG. 10, 605–606, 625

[56] References Cited

U.S. PATENT DOCUMENTS

| | | | |
|---|---|---|---|
| 4,249,447 | 2/1981 | Tomisawa | 84/605 |
| 4,655,115 | 4/1987 | Nishimoto | 84/1.19 |
| 4,991,218 | 2/1991 | Kramer | 381/61 |
| 5,033,352 | 7/1991 | Kellogg et al. | 84/658 |
| 5,191,161 | 3/1993 | Oya | 84/604 |

*Primary Examiner*—William M. Shoop, Jr.
*Assistant Examiner*—Marlon T. Fletcher

[57] ABSTRACT

An apparatus and method for electronically producing music includes an adder coupled to a sinusoid memory, wherein the sinusoid memory is a look-up table including various sinusoidal waves having differing output characteristics. A feedback path between the output of the sinusoid memory and an input of the adder includes a register coupled to a feedback modifier device. The feedback modifier device includes a second look-up table which substitutes a feedback component β into the sinusoidal wave output from the sinusoid memory. The output of the feedback modifier device is an arbitrary function of the selected wave from said sinusoid memory and the selected value of the feedback component.

20 Claims, 7 Drawing Sheets

TONE PRODUCTION METHOD AND APPARATUS FOR ELECTRONIC MUSIC

FIELD OF THE INVENTION

The present invention relates to tone production devices for generating electronic music, and more particularly to a method and apparatus for continually varying partial contents of a tone wave.

BACKGROUND OF THE INVENTION

Various methods have been proposed in the prior art to electronically synthesize musical tones. One method involving frequency modulation is described in U.S. Pat. No. 4,249,447 to Tomisawa. The basic unit for accomplishing the digital frequency modulation includes an adder and a sinusoidal wave memory having values selected based on an output of the adder. In the unit, a waveform "x" represented by a sequence of digital samples is added to an output of the sinusoidal wave memory at a suitable feedback ratio. A multiplier is inserted in the feedback loop for multiplying the output of the memory, sin y, by a feedback parameter β. The product of the multiplication βsin y is applied to the adder which results in the expression x+βsin y. The output of the adder x +βsin y constitutes an input address to the sinusoidal wave memory. Partial contents of a tone wave produced by the above-described unit are controlled by changing the value of the feedback parameter β.

Although the device described in Tomisawa is relatively straightforward to implement, a disadvantage is that the harmonic spectrum achievable by simple multiplication is somewhat limited. In addition, for certain values of the feedback parameter, the amplitude data of both positive and negative values is alternated much too rapidly at each output sampling point of the memory causing an undesirable hunting phenomenon to occur. In order to eliminate the hunting phenomenon, an additional averaging device must be inserted in the feedback path.

Another device for generating frequency modulated music is manufactured by the AT&T Corporation under the tradename "RIO/Roadrunner". In the device, a frequency modulation algorithm is replicated utilizing floating-point DSP code. Instead of a feedback path, a large look-up table memory is used containing complex waveforms. The complex waveforms attempt to include the effect of feedback for various feedback parameters, as in Tomisawa. Due to constraints on available memory, however, limitations exist on the quality of the harmonic spectrum. Accordingly, there is a need for a device which produces a more tailored harmonic spectrum than that achievable with devices of the prior art.

SUMMARY OF THE INVENTION

The present invention discloses an apparatus and method for electronically producing music. The present invention includes an adder coupled to a sinusoid memory, wherein the sinusoid memory is a look-up table including various sinusoidal waves having differing output characteristics. A feedback path between the output of the sinusoid memory and an input of the adder includes a register coupled to a feedback modifier device. The feedback modifier device includes a second look-up table which substitutes a feedback component β into the sinusoidal wave output from the sinusoid memory. The output of the feedback modifier device is an arbitrary function of the sinusoidal wave output and the feedback component β. One such function may be representative of a multiplication between a selected wave from said sinusoid memory and a selected value of the feedback component.

BRIEF DESCRIPTION OF THE FIGURES

For a better understanding of the present invention, reference may be had to the following description of exemplary embodiments thereof, considered in conjunction with the accompanying drawings, in which.

DETAILED DESCRIPTION

Figure 1:
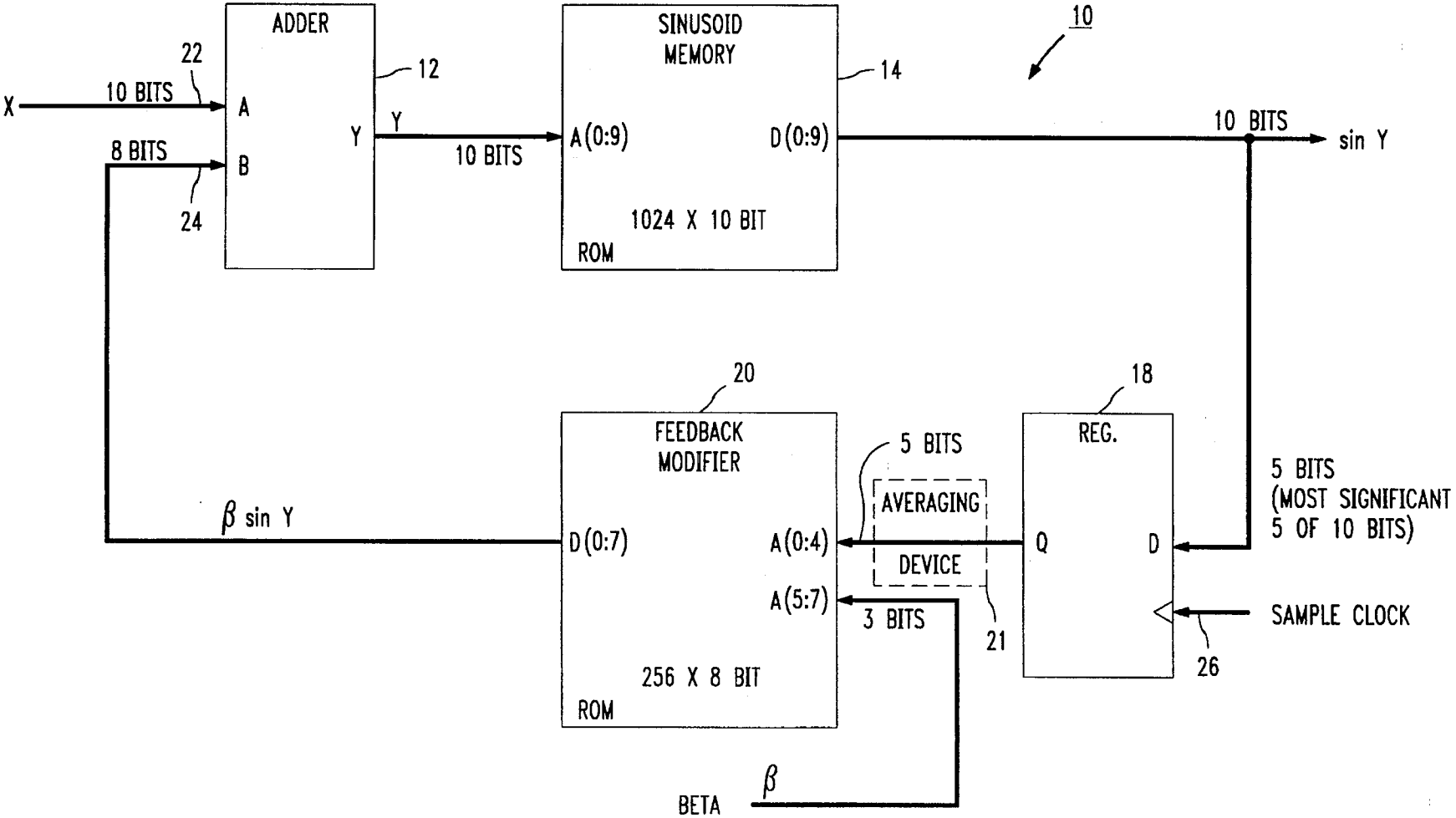
FIG. 1 shows a block diagram of one preferred embodiment of an arithmetic unit for producing musical tones according to the present invention.

The present invention discloses a novel method and apparatus for production of tones used in the synthesis of electronic music. Referring to FIG. 1, there is shown one preferred embodiment of an arithmetic unit 10 for electronically producing music in accordance with the present invention. The arithmetic unit 10 is a digital device and includes an adder 12 coupled to a sinusoid memory 14, wherein the sinusoid memory is a look-up table including various sinusoidal waves having differing output characteristics. A feedback path between the output of the sinusoid memory 14 and an input of the adder 14 includes a register 18 coupled to a feedback modifier device 20. The feedback modifier device 20 is essentially a second look-up table, with the possible addition of other circuitry, which combines a feedback component 13 with the sinusoidal wave output from the sinusoid memory 14 in order to produce an address input for the feedback modifier device 20.

As can be seen, the adder 12 of the present invention includes a first and second input 22, 24, wherein the data present at the first and second inputs is added together in a known manner. In a preferred embodiment of the present invention the adder shown in FIG. 1 is a 10 bit adder, however, it will be understood by those skilled in the art that other size adders and other sizes of data may be input to the adder depending on the degree of accuracy and/or precision necessary in a specific application. Note that in the preferred embodiment, only 8 bits of the B input of adder 12 are required for adequate waveshape accuracy.

A first input 22 to the adder 12 is a variable "X" represented by a sequence of digital samples representing values between $-\pi$ and $\pi$. A second input 24 to the adder, βsin y, is an output from the feedback modifier 20. In the preferred embodiment, these two values are added to produce an 10-bit value "Y" at the output of the adder. The 11th bit which may result from the addition of the two inputs has been eliminated since the output is a modulo ($2\pi$) value. As would be understood the single drawing lines emanating from each of the components of FIG. 1 are representative of parallel data on a bus structure.

Figure 2:
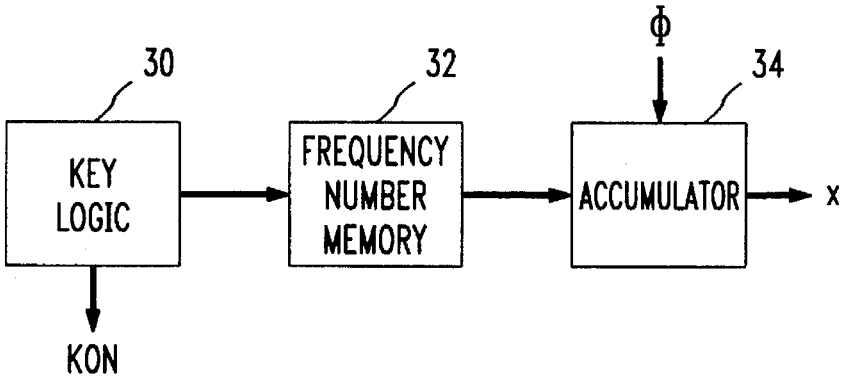
FIG. 2 PRIOR ART
FIG. 2 shows a block diagram of an exemplary embodiment of a circuit for producing a sequence of digital values (x) used in generating electronic musical tones.

The variable X at the first input of the adder 12 is representative of a signal generated, for example, from a keyboard-type device. FIG. 2 shows an exemplary device for producing the signal X, which device includes key logic 30, frequency number memory 32 and an accumulator 34. A signal representing a key depressed in a keyboard is supplied from the key logic 30 to the frequency number memory 32. A frequency number which is a constant corresponding to the frequency of the depressed key, i.e., phase increment, is read from the frequency number memory 32. The frequency number read from the memory is applied to an accumulator where the frequency number is repeatedly added in accordance with a clock pulse $\phi$. The accumulator consists, for example, of a counter of modulo M and the output of the accumulator is supplied to the adder 12 as the variable X.

The output Y (10 bits) of the adder 12 is input to the address lines of the sinusoid memory 14. Depending on the specific address input to the memory, a corresponding wave value, sin y, is selected in the look-up table and output via the data lines of the sinusoid memory device 14. In the shown embodiment, the sinusoid memory is represented as a 1024×10 bit ROM. It will be understood, however, that different sized memory devices may be utilized depending on the necessary precision, and that Random Access Memory (RAM) may also be used instead of ROM. Systems utilizing RAM as the memory devices would have the advantage of being re-programmable with different waveforms.

The output of the sinusoid memory 14 is also connected into a feedback path. In the preferred embodiment shown in FIG. 1, the 5 most significant bits of the 10 bits output by the memory are input to a data register 18. The data register may be comprised of a series of flip-flops, as shown, or other device capable of temporarily staging data. The data register 18 includes a sampling clock input, 26 which enables data from the register to be clocked into the feedback modifier 20 at the same rate at which the digital values X are introduced to the adder 12. The data register has the purpose of synchronizing the two components presented as inputs to adder 12. The data register is clocked at the same time as the device which generates the samples which comprise X. Thus it will be understood that data register 18 may be placed at other locations in the feedback path including, but not limited to, before or after adder 12.

In the shown embodiment of the invention, the feedback modifier 20 is a 256×8 bit ROM. The feedback modifier includes two sets of inputs. The 5 most significant bits from the sinusoid memory 14 are input through the data register 18 as the least significant bit inputs to the feedback modifier, i.e., at address line A(0:4). A value for the feedback component, $\beta$, is input at the 3 most significant bits of the feedback modifier 20 at address lines A(5:7). The combined address of the five least significant bits and the three most significant bits ($\beta$) make up an 8-bit address at the feedback modifier look-up table. This address references a memory location having an 8-bit data value stored therein corresponding to the value of sin y modified by the feedback component ($\beta$). The output on the data lines of the feedback modifier is thus f ($\beta$,sin y).

As can be seen, the feedback component $\beta$ may be altered by the selection of the 3 most significant bits input to the feedback modifier 20, wherein the makeup of the sign wave is determined by the output of the sinusoid memory 14. As would be understood, the memory size of the feedback modifier and the exact number of bits reserved for the sine wave component and the feedback value will be determined based on a desired precision for the output wave. The feedback modifier look-up table 20 is advantageous in that a more tailored harmonic spectrum is produced than that achievable by simple multiplication. That is, the feedback modifier 20 produces values that are selectable to more precisely control the harmonic content of the final waveform. In addition, the circuitry of the instant embodiment is less complicated than is the circuitry of a multiplier in certain implementations.

Figure 5A:
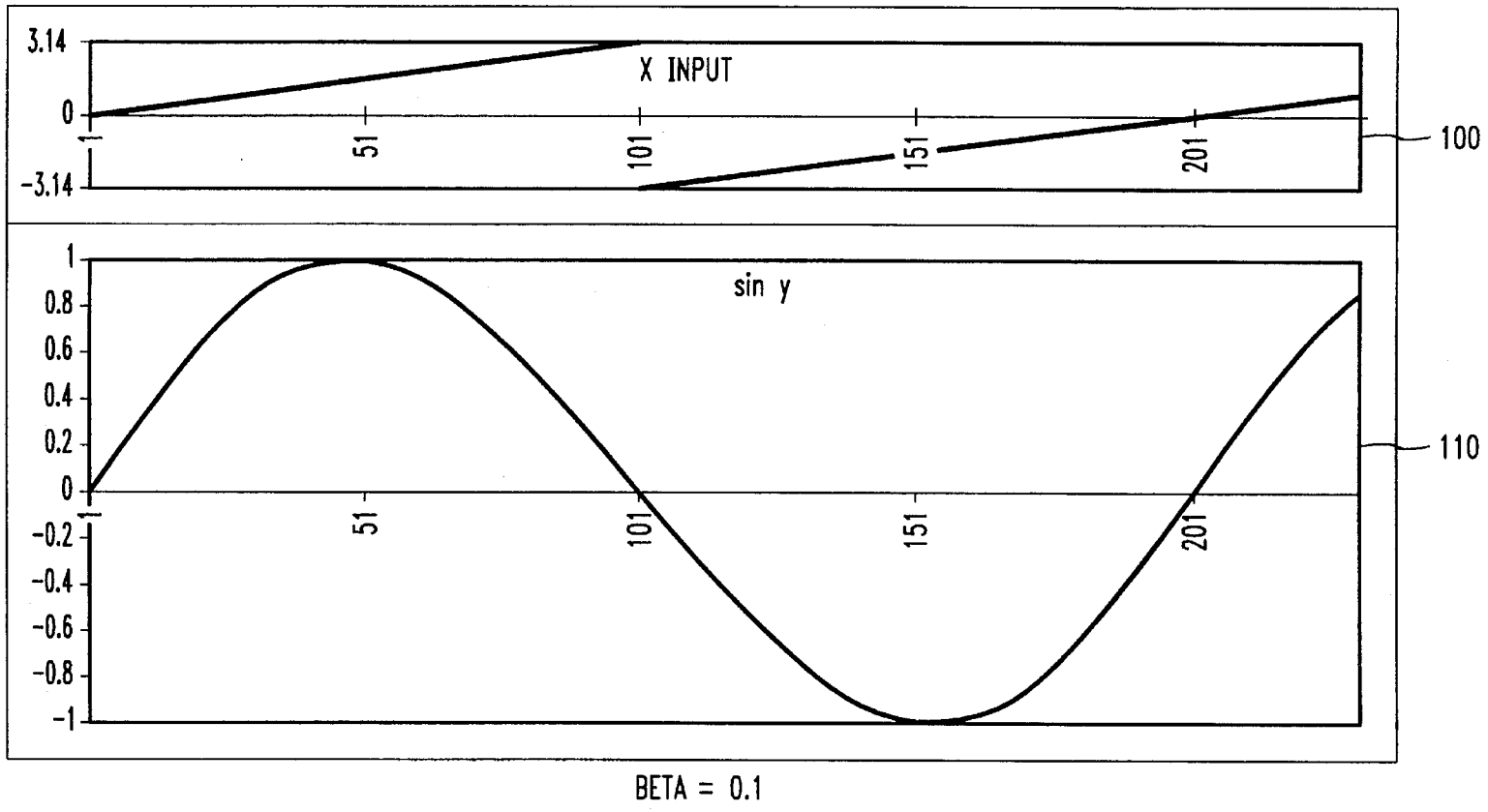
FIGS. 5*a*, 5*b*, 5*c* and 6 show changes in the output wave-shape of the feedback modifier for sample points for the multiplication of sin y by β as the values of β gradually increase.
Figure 5B:
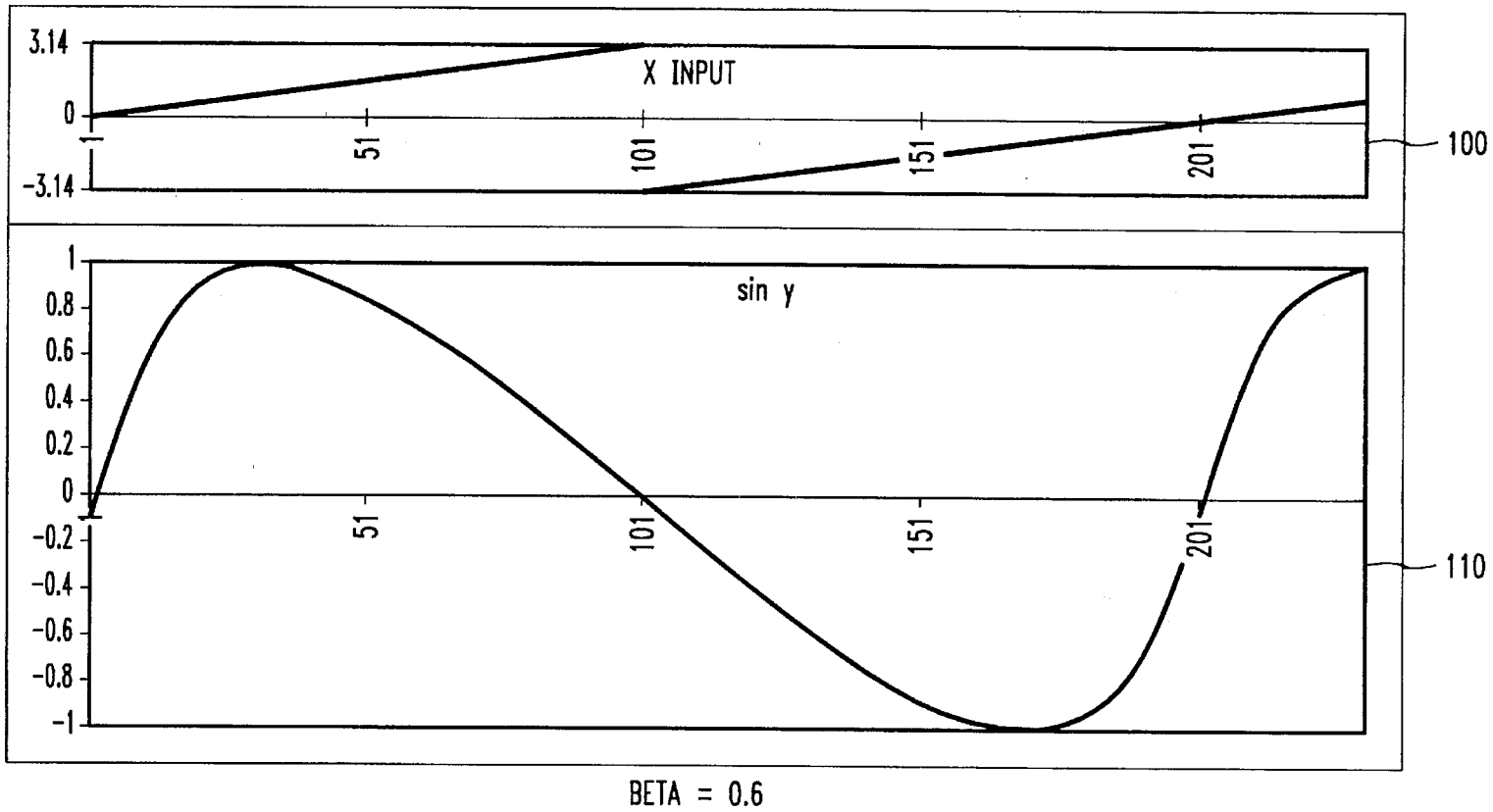
Figure 5C:
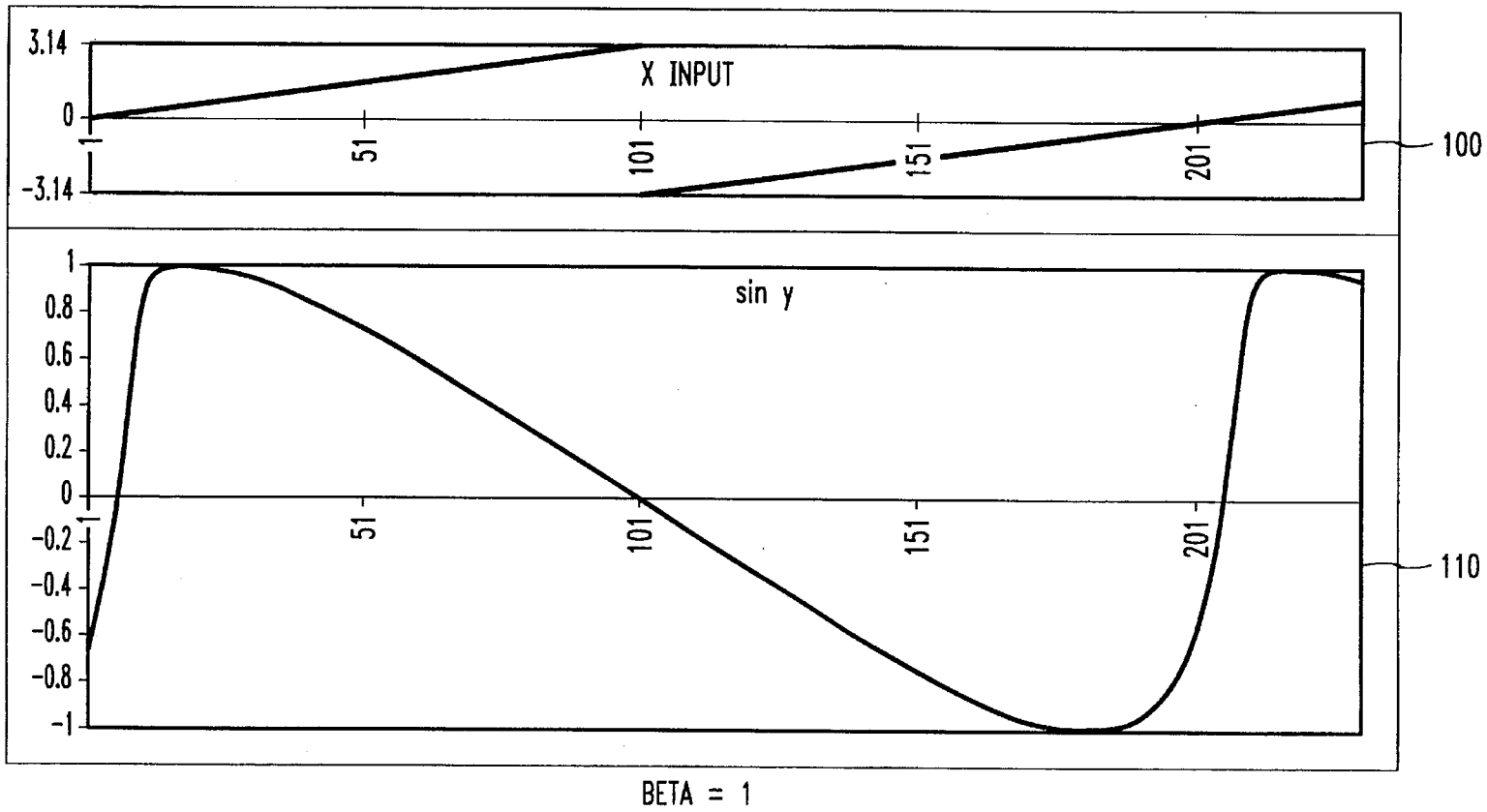
Figure 6:
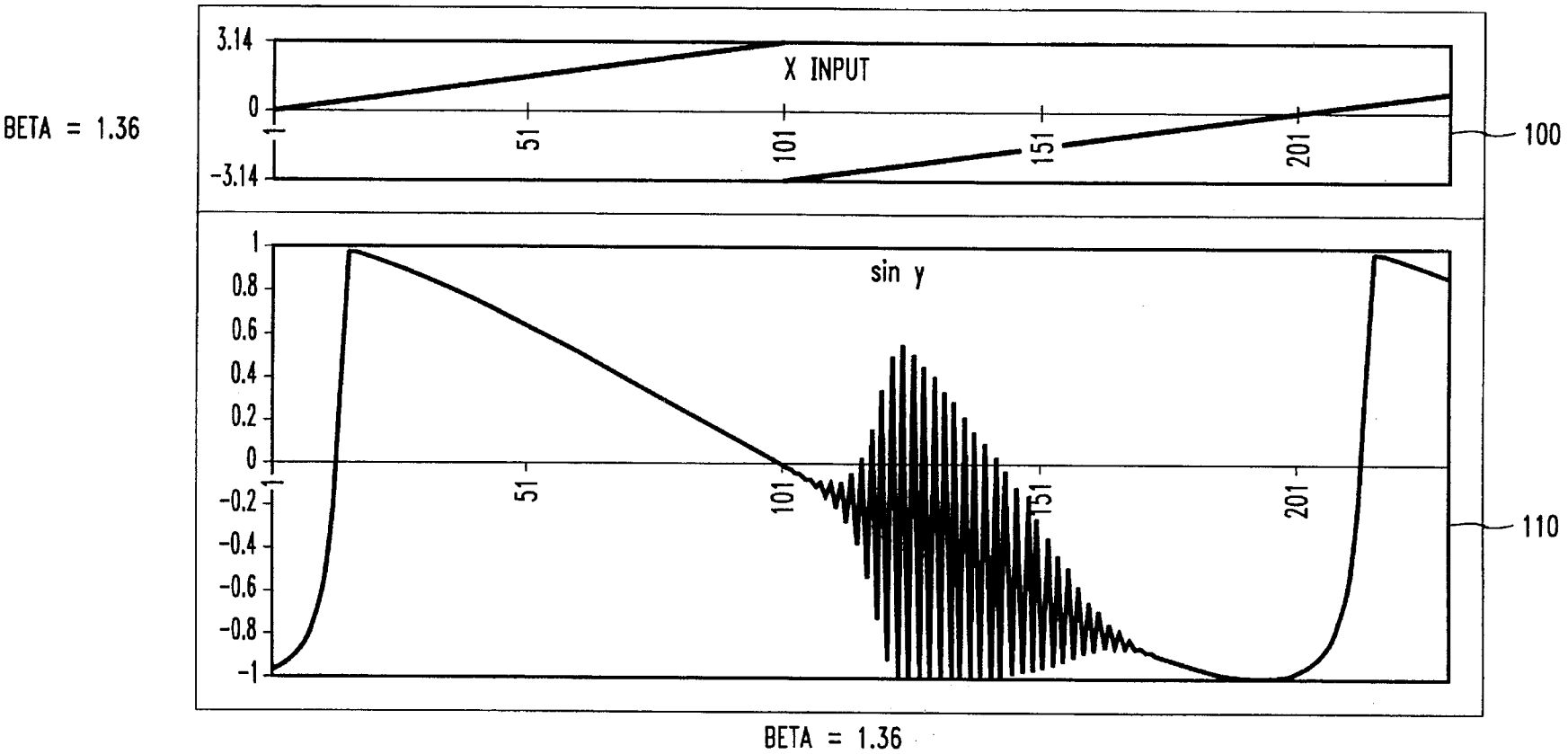

Now, in the case that the function of the feedback modifier is that of multiplication of sin y by $\beta$, it can be seen that as the value of $\beta$ increases from 0 to 1 (See FIGS. 5-*a* through 5-*c*.), the waveshape changes from sinusoidal in shape to sawtooth in shape, with a corresponding increase in the harmonic content of the waveform. In each of the figures, the upper graph 100 shows a continuously varying sequence of samples presented at the x-input of the adder between $-\pi$ and $\pi$. The range from $-\pi$ and $\pi$ is divided into 200 samples. The lower graph 110 shows the corresponding value of sin y for each of the samples. When the value of $\beta$, equals or exceeds approximately 1.3, a rapid oscillation of the waveform sin y may be observed in the vicinity of sin y=0 (See FIG. 6.). This oscillation is comprised of alternating positive and negative offsets from the expected sawtooth-like waveshape. This oscillation occurs at one-half the sample generation rate of the sin y waveform. The oscillation is not due to any defect in the circuitry, but rather is due to the feedback aspect of the circuit. In the region in which the sin y waveform has negative slope, the feedback is negative. That is, when the output y of the adder 12 increases, the value of sin y in the region described decreases. This decreased value, multiplied by a positive $\beta$ in feedback modifier 20, is fed into the adder 20, creating a tendency for the adder output y to decrease, which in turn creates a tendency for the value of sin y to increase. This cycle repeats, causing alternating negative and positive influences on the waveform sin y. When the negative feedback becomes strong enough, oscillation occurs.

The onset of oscillation is dependent both on the magnitude of $\beta$ and the slope of the waveform sin y, since (sin y)/y is both negative and has the greatest magnitude at the point y=$\pi$. In fact, in can be shown that oscillation will begin only when the product ($\beta$)(slope (sin y) ) becomes less than approximately negative 0.56.

If desired, this oscillation may be filtered by inserting an averaging device 21 somewhere in the feedback path. One such averaging device is a circuit which stores a sample, using a register or similar device, so that it may be added to the next consecutive sample by known processing, the result of such addition being divided by two by known processing. The averaging device 21 may be inserted in the circuit most advantageously between the adder output sin y and the feedback modifier 20 due to the reduced number of bits to be stored. In fact, it may become a part of the feedback modifier 20. It will be understood, however, that the averaging device will be effective if inserted anywhere in the feedback loop comprised of items 12, 14, and 20. Additionally, three, four, or more consecutive samples may be averaged by similar known processing, resulting in more effective suppression of the described oscillation. Also, it is noted that the truncation of the sin y waveform data to the most significant 5 bits before being fed into feedback modifier 20 has the additional effect of filtering the described oscillation. If filtering is used, the preferred embodiment is truncation of the fed-back sin y waveform, followed by averaging two consecutive samples, which provides effective filtering using simple circuitry.

It should be noted that with even large amounts of filtering, oscillation will once again begin when the value of β gets sufficiently large, due to the effect of negative feedback. In some cases this oscillation may in fact be desirable for the harmonic content it adds to the waveform output. Beyond a certain level of feedback, the oscillation so affects the waveform that further increases in feedback have little audible effect. In this case, the feedback modifier may be adjusted to increase the amount of filtering as the value β increases.

Figure 3:
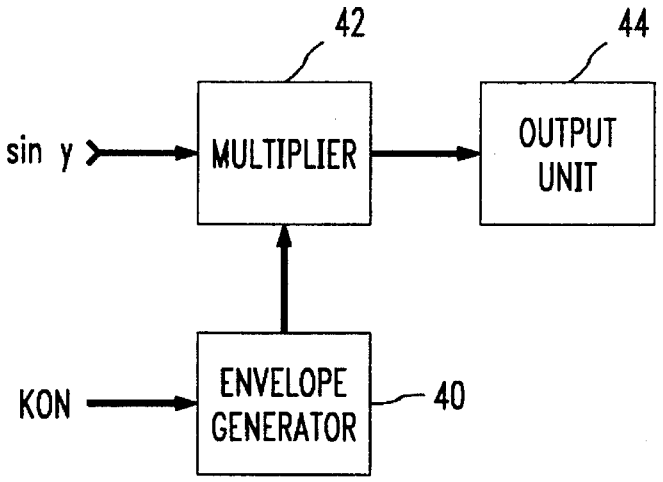
FIG. 3 PRIOR ART
FIG. 3 shows a block diagram of an exemplary unit for processing the output tone waveform as a musical tone.

The tone waveform sin y provided at the output of the arithmetic unit may be further processed for production of a musical tone. Referring to FIG. 3 there is shown exemplary circuitry for processing the signal provided from the arithmetic unit. An envelope generator 40 generates an envelope shape signal in response to a key-on signal provided by the key logic 30 of FIG. 2, in accordance, for example, with the depression of a key. This envelope shape signal is supplied to a multiplier 42. The multiplier 42 multiplies the tone waveform sin y provided by the arithmetic unit 10 with the envelope shape signal to impart an amplitude envelope to the tone waveform sin y. The tone signal outputted from the multiplier is applied to an output unit 44 and is then heard as a musical tone by means of known processing such as conversion to an analog signal and filtering.

As will be understood, the variable X input to the adder 12 (of FIG. 1) increases quickly if the frequency number read from the frequency number memory 32 is large, and increases slowly if the frequency number is small. The variation rate of the variable X thus determines the frequency of a tone produced by the arithmetic unit 10. Harmonic contents of a tone provided by the arithmetic unit can be continuously controlled by changing the value of the feedback parameter β. It will also be understood that the sinusoid memory having its input address modulated according to the present invention may be used not only for producing a desired tone waveform, but also for modulating an input address of another waveform memory. In the latter case, the tone waveform is produced by the other waveform memory.

In the above description of the present invention, the sinusoid memory 14 has been described as a memory storing a sine wave. It will be understood that the memory is not so limited and that a memory storing a cosine wave or a sine function having an initial phase may be employed as effectively as the memory described. Additionally, sawtooth, triangular, or irregular wave shapes may be employed. Also the waveform stored therein is not limited to a full period waveform, but may include other portions thereof wherein a full period waveform may be reproduced by known methods.

Figure 4:
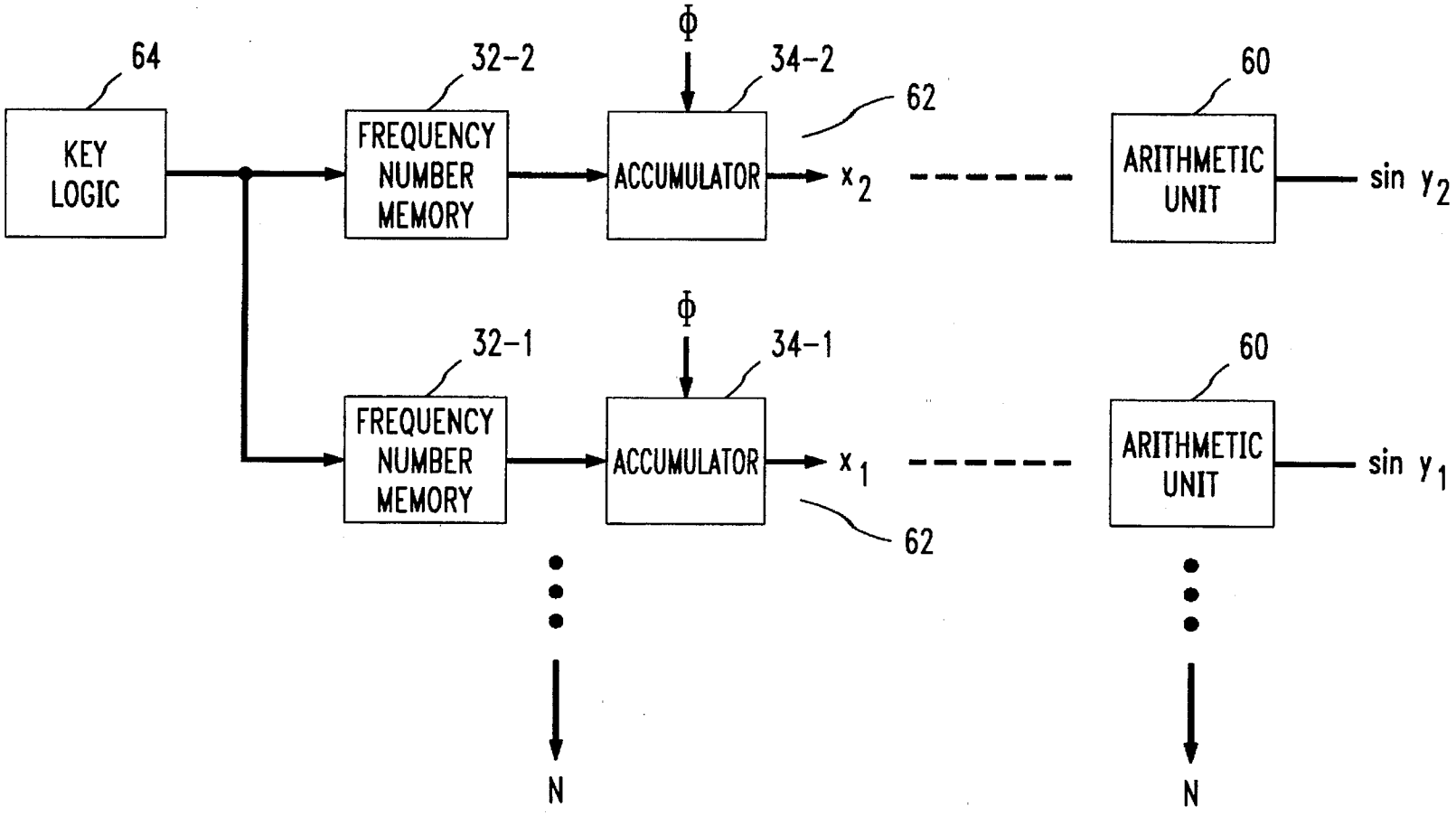
FIG. 4 shows an alternate embodiment for simultaneously producing multiple tones according to the present invention.

Referring to FIG. 4, there is shown an alternate embodiment of the present invention. In the shown embodiment, a plurality of arithmetic units 60, as in FIG. 1 are coupled to a plurality of inputs 62 generated from a single input device 64. As would be understood, the present invention may be utilized to simultaneously create a series of tones from multiple arithmetic units at one time, wherein these tones are latter processed and combined in an output.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined in the appended claims.

What is claimed is:

1. The apparatus for electronically producing musical tones, said apparatus comprising:

digital adding means for adding together data present at a first and second input thereof, said first input being coupled to an input device adapted to produce a sequence of digital samples;

a sinusoidal memory table coupled to an output of said digital adding means for storing predetermined waveforms of a selected repetition frequency according to an input address; and a feedback modifier table coupled to an output of said sinusoidal memory table for storing modified versions of said predetermined waveforms having varying degrees and varying types of feedback introduced therein, said modified versions of said predetermined waveforms being selectable according to an input address, an output of said feedback modifier table being coupled to said second input of said digital adding means, wherein said feedback modifier table is coupled in a feedback path between said digital adding means and said memory table.

2. The apparatus of claim 1, wherein said modified versions of said predetermined waveforms stored in said feedback modifier table are representative of a multiplication between said predetermined waveforms and a predetermined feedback value.

3. The apparatus of claim 2, wherein said predetermined feedback value for said modified versions of waveforms in said feedback modifier table is selectable based on a range of input addresses for said feedback modifier table.

4. The apparatus of claim 1, wherein an output of said sinusoid memory table is coupled to a processing means for production of a musical tone.

5. The apparatus of claim 4, wherein said processing means includes an envelope generator for generating an envelope shape signal in response to signals from said input device; and multiplier for multiplying said envelope shape signal with an output from said sinusoid memory table, the product of said multiplier being output to an output unit to thereby generate said musical tone.

6. The apparatus of claim 1, further including a data register coupled within the circular path comprised of said sinusoid memory table, said feedback modifier table, and said digital adding means for synchronizing said output of said feedback modifier table with said first input of said digital adding means.

7. The apparatus of claim 1, wherein said adding means, said sinusoid memory and said feedback modifier table are comprised in an arithmetic unit, further including a plurality of arithmetic units coupled to a plurality of inputs from said input device to thereby simultaneously produce a series of musical tones.

8. The apparatus of claim 1, wherein said input device includes:

frequency number memory for storing predetermined frequencies, said frequency number memory adapted to accept signals generated from input logic for selecting a frequency; and accumulator means coupled to said frequency number memory for repeatedly adding said frequency selected from said frequency number memory in accordance with a predetermined clock pulse, an output of said accumulator being coupled to said first input of said digital adding means.

9. The apparatus of claim 1, wherein said input address to said feedback modifier table is a combination address representative of said predetermined waveform and a selected feedback parameter.

10. The apparatus of claim 1, wherein a predetermined number of least significant bits are truncated from said output of said sinusoidal memory prior to being input to said feedback modifier table to thereby provide filtering of the input to said feedback modifier table.

11. The apparatus of claim 10, further including an averaging means coupled within the circular path comprised of said sinusoid memory table, said feedback modifier table, and said digital adding means for averaging at least a previous value in said path with a current value in said path to thereby filter an output signal of said feedback modifier table.

12. A method for electronically producing musical tones, said method comprising the steps of:

adding a sequence of digital samples representative of selected frequencies generated from an input device together with data produced from a feedback path;

referencing a memory table having predetermined waveforms of a selected repetition frequency stored therein, wherein a predetermined waveform is output from said memory table based on an input address provided from said step of adding; and selecting modified versions of said predetermined waveforms having varying degrees of feedback introduced therein from a feedback modifier table contained in said feedback path, said modified versions of said predetermined waveforms being selectable according to an input address, wherein modified versions of said predetermined waveforms are output in said feedback path as an input for said step of adding.

13. The method of claim 12, wherein said input address to said feedback modifier table is a combination address representative of said predetermined waveform and a selected feedback parameter.

14. The method of claim 12, wherein said modified versions of said predetermined waveforms stored in said feedback modifier table are representative of a multiplication between said predetermined waveforms and a predetermined feedback value.

15. The method of claim 14, wherein said predetermined feedback value for said modified versions of waveforms in said feedback modifier table are selectable based on a range of input addresses for said feedback modifier table.

16. The method of claim 12, further including the step of processing an output of said memory table to produce a musical tone.

17. The method of claim 16, wherein said step of processing includes the step of generating an envelope shape signal in response to signals from said input device; and multiplying said envelope shape signal with an output from said memory table, the product of said multiplier being output to an output unit to thereby generate said musical tone.

18. The method of claim 12, further including the steps of:

temporarily storing values representative of selected portions of said predetermined waveforms in a data register; and inputting address data to said feedback modifier at a predetermined sample clock rate.

19. The method of claim 12, wherein said adding means, said sinusoid memory and said feedback modifier table are comprised in an arithmetic unit, further including the step of coupling a plurality of arithmetic units to a plurality of inputs from said input device to thereby simultaneously produce a series of musical tones.

20. The method of claim 19, further including the steps of:

selecting a frequency from a frequency number memory based on signals generated from input logic; and repeatedly adding said frequency selected from said frequency number memory in accordance with a predetermined clock pulse, wherein an output thereof is added as said sequence of digital samples.

* * * * *